US005187849A

United States Patent [19]

Kobayashi

[11] Patent Number: 5,187,849

[45] Date of Patent: Feb. 23, 1993

[54] FIXING ROLL FOR ELECTROPHOTOGRAPHY HAVING AN OUTER FLUORO-RESIN COATING

[75] Inventor: Naofumi Kobayashi, Fuji, Japan

[73] Assignee: Nitto Kogyo Co., Ltd., Tokyo, Japan

[21] Appl. No.: 904,298

[22] Filed: Jun. 25, 1992

Related U.S. Application Data

[62] Division of Ser. No. 566,922, Aug. 14, 1990.

[30] Foreign Application Priority Data

Aug. 24, 1989 [JP] Japan ..... 1-215997

[51] Int. Cl.[5] ..... B21B 31/08

[52] U.S. Cl. ..... 29/492/59; 29/895.32; 355/285

[58] Field of Search ..... 29/895, 895.3, 895.32, 29/895.33, 132; 427/359, 369; 355/285, 289

[56] References Cited

U.S. PATENT DOCUMENTS

| | | | |
|---|---|---|---|
| 3,852,861 | 12/1974 | Baker et al. | 29/132 |
| 3,942,230 | 3/1976 | Nalband | 29/895.32 |
| 4,700,450 | 10/1987 | Michel | 29/895.32 |
| 4,810,564 | 3/1989 | Takahashi et al. | 29/132 |
| 4,950,538 | 8/1990 | Honda et al. | 29/132 |

FOREIGN PATENT DOCUMENTS

| | | |
|---|---|---|
| 302517 | 2/1989 | European Pat. Off. . |
| 57-43892 | 12/1982 | Japan . |
| 61-72273 | 4/1986 | Japan . |
| 61-153179 | 7/1986 | Japan . |
| 62-231281 | 10/1987 | Japan . |
| 63-4287 | 1/1988 | Japan . |

*Primary Examiner*—P. W. Echols
*Assistant Examiner*—David P. Bryant
*Attorney, Agent, or Firm*—Lowe, Price, Leblanc & Becker

[57] ABSTRACT

A fixing roll used for electrophotography in which a fluoro resin layer having a surface roughness Rz of not greater than 3.5 μm, gloss of not greater than 50% and an angle of contact with water of not less than 115° is coated on outer surface of the roll. The fixing roll is manufactured by a method which comprises coating a fluoro resin paint to the surface of a core thereby forming coating layer, applying smoothing fabrication to the surface of the coating layer and, subsequently, applying heat treatment to form a fused fluoro resin layer.

13 Claims, No Drawings

FIXING ROLL FOR ELECTROPHOTOGRAPHY HAVING AN OUTER FLUORO-RESIN COATING

This application is a division of application Ser. No. 07/566,922, filed Aug. 14, 1990.

FIELD OF THE INVENTION

The present invention concerns a fixing roll used in an electrophotographic apparatus for fixing toner particles on copy paper.

BACKGROUND OF THE INVENTION

As a fixing roll for electrophotography, there has been used a roll comprising a cylindrical core made of aluminum, iron or stainless steel coated with an easily releasable material, for example, a fluoro resin such as a polytetrafluoroethylene (hereinafter referred to as PTFE resin), a copolymer of tetrafluoroethylene and perfluoroalkyl perfluorovinyl ether (hereinafter referred to as PFA resin).

Such a fixing roll is opposed under pressure to a press roll coated with a silicone rubber or fluoro rubber to constitute a fixing device. Copy paper is passed between the heated fixing roll and the press roll to fuse powdery toner images formed thereon by means of heat and pressure and fix them onto the copy paper. An image formed on the paper by toner particles is pressed under heat so as to be fused and fixed on the paper.

One method employed for manufacturing a fixing roll having a coating layer of the fluoro resin is a method of coating a fluoro resin powder or fluoro resin dispersed liquid onto the surface of the core and then sintering it at a temperature of 360° to 400° C. to effect fusion deposition thereof on the surface. However, the thickness of the coating layer is not always uniform because of unevenness left after the coating. Since the nonuniformity in the thickness of the fluoro resin layer changes the press-contact force upon toner fixation, deterioration of the quality of the fixed image results. Therefore, the fluoro resin layer after sintering has conventionally been ground into a predetermined thickness by using sandpaper or a grinding stone, also improving the smoothness of the surface.

However, such a surface grinding involves the problems of causing deep scratches and of taking many working steps. Accordingly, there has been proposed a method of smoothing the surface by a press roll instead of grinding it (refer to Japanese Patent Laid-Open Sho 57-43892).

The smoothing of the fixing roll surface by the above-described conventional method is effective for improving the quality of the fixed image. However, it is not always effective for the improvement of an offset phenomenon, that is, a phenomenon that toner particles fused upon fixing of the toner image are deposited onto the fixing roll and the deposited toner particles are transferred to the subsequent copy paper as contaminant.

The offset phenomenon is generally classified into a so-called high temperature offset and a so-called low temperature offset. The high temperature offset is caused by the deposition of the fused toner on the fixing roll, while the low temperature offset is caused by the deposition of unfused toner particles on the fixing roll, which are determined depending on the distribution of the surface temperature of the fixing roll, drop in temperature upon paper passage, toner characteristics, etc.

Accordingly, it is required for the fixing roll that the temperature for causing the high temperature offset is higher and the temperature for causing the low temperature offset is lower. However, the fixing roll obtained by the above-mentioned conventional method involves a problem that the temperature ranges for causing the high temperature offset and for causing the low temperature offset are close to each other and thus, the non-offset temperature range is narrow.

OBJECT OF THE INVENTION

It is, accordingly, an object of the present invention to provide an improved fixing roll achieving offset temperature range, as well as to provide a method of manufacturing thereof.

SUMMARY OF THE INVENTION

The foregoing object of the present invention can be attained in a fixing roll for electrophotography in not greater than 3.5 μm, a gloss or glossiness of not greater than 50% and an angle of contact with water not less than 115° is disposed to the surface of the roll.

The fixing roll according to the present invention can be manufactured by coating a fluoro resin paint onto the surface of a core to form a coating layer, smoothing the surface of the coating layer, and then applying a heat treatment to form a fused fluoro resin layer.

The core used in the present invention is, preferably, of a hollow cylindrical shape, in which a heat-generating member used for heating can be mounted.

There are no particular restrictions for the fluoro resin paint coated on the core. A dispersion of PTFE resin, PFA resin or a blend thereof in a liquid medium is preferably used. An organic or inorganic filler may be blended with such a paint if required. As the filler, there can be used fibrous or finely powdered fillers, for example, of carbon, potassium titanate, metal oxide, ceramic, glass or metal. A material suitable to provide a desired property such as charge-eliminating or abrasion-resistant properties can be selected and blended.

Generally, it has been known that an excellent charge-eliminating property can be provided by incorporating 3 to 8% by weight of carbon in the surface resin layer of the fixing roll. In the present invention, however, excellent charge-eliminating performance can be obtained by mixing a much smaller amount of carbon than in the conventional methods as described above, that is, about from 0.5 to 3% by weight and, in particular, from 0.5 to 1% by weight of carbon.

The fluoro resin layer is coated on a hollow core coated with a primer by, for example, spray coating, and then dried at a temperature from a room temperature to about 100° C. for 30 min. to one hour, to form a dried coating layer of the fluoro resin. Since the dried coating layer of the fluoro resin is not sintered and fluoro resin particles are merely overlapped with each other, there is an unevenness on the surface profiling the shape of the particles, which tend to drop off upon applying strong rubbing.

A smoothing process is applied to the surface of the dried fluoro resin coating layer thus formed on the core. An example of such smoothing is a method of urging a press roll made of metal, which has a mirror-finished surface, against the rotating core under a pressure of about 1 to 20 kg while rotating the roll, crushing the dry fluoro resin layer while axially moving the press roll, for example, at a rate of 2 cm/sec, and thereby smoothing the surface into a mirror-finished state. According to this method, since the resin layer can be easily smoothed by a much lower pressing force, different from the conventional smoothing of the fluoro resin layer fusion-deposited by sintering, there is no disadvantage causing distortion on the core. Means for smoothing the surface is not restricted only to the method of using a press roll but any appropriate means can be utilized.

The dry fluoro resin layer smoothed as described above can be converted into a smooth fluoro resin layer without flaw or scratch by sintering at a temperature, for example, from 360° to 400° C. for a period of time, for example, from 10 min. to 1 hour. The resin layer appears matted with a glossiness of not greater than 50%. In addition, the surface roughness of the resin layer is substantially equal to that obtained by the conventional method of grinding the surface or mirror-finishing the surface with the press roll after sintering, that is, of less than 3.5 μm of ten-point average roughness Rz.

The feature of the fixing roll according to the present invention thus obtained lies in that the contact angle of the fluoro resin layer surface with water shows a particularly great value. That is, when a water droplet is placed on the surface of the fixing roll in accordance with the present invention and the angle of contact is measured, it shows an angle of contact not less than 115°. On the other hand, that value is not greater than 110° for the surface smoothed fluoro resin layer of the prior art.

The fixing roll used for electrophotography according to the present invention having the foregoing characteristics has the fluoro resin layer of high density obtained by smoothing its surface under pressure and then sintering it for fusion deposition. The thus obtained roll is free from offset phenomenon and is excellent in abrasion resistance and durability.

DESCRIPTION OF PREFERRED EMBODIMENTS

EXAMPLE 1

After coating a primer (EK 1909 BKN, manufactured by Daikin Kogyo Co.) on a hollow core having 30 mm diameter and 300 mm length, a solution of PTFE resin (ED 4300 CRN, manufactured by Daikin Kogyo Co.) was coated thereon. After drying at 80° C. for 30 min. to form a dry fluoro resin coating layer, a metal press roll having a mirror-finished face is brought into contact with the core under a pressure of 6 kg. Then, the core was rotated and the press roll was moved axially at a rate of 2 cm/sec to smooth the dry fluoro resin coating layer into a mirror-finished state. The ten-point average roughness Rz was 2 μm.

The roll was sintered in a sintering furnace at 380° C. for 30 min., so that the fixing roll has a fluoro resin layer of 30 μm thickness.

The ten-point average roughness of the thus obtained fixing roll, Rz, was 2.0 μm.

Further, a halogen light at 580–600 nm was applied at an incident angle of 75° from a gloss meter (ND-KS, VG-107 type, manufactured by Nippon Denshoku Co.) and the gloss of the surface was 9.1% at an angle of the reflection light of 75°.

Further, a water droplet was placed on the surface and the angle of contact of the fluoro resin surface with the water was measured by a contact angle gauge. The measured angle was 118°–120°.

EXAMPLE 2

A fixing roll was manufactured quite in the same procedures as those in Example 1 except for coating a solution of a PTFE resin (ED 4300 CRN, manufactured by Daikin Kogyo Co.) mixed with 0.75% by weight of carbon black.

The ten-point average roughness Rz was 2.0 μm, the gloss 4.2% and the angle of contact 120° to 126°.

EXAMPLE 3

A fixing roll was manufactured quite in the same procedures as those in Example 1 except for coating a solution of a PTFE resin (ED 4300 CRN, manufactured by Daikin Kogyo Co.) mixed with 3% by weight of tin oxide.

The ten-point average roughness Rz was 2.0 μm, the gloss 46.8% and the angle of contact 118° to 124°.

COMPARATIVE EXAMPLE 1

After coating a primer (EK 1909 BKN, manufactured by Daikin Kogyo Co.) on a hollow core having 30 mm diameter and 300 mm length, a solution of a PTFE resin (ED 4300 CRN, Daikin Kogyo Co.) was coated and dried at a temperature of 80° C. for about 30 min.

Subsequently, it was sintered at a temperature of 380° C. for 30 min. and ground with #800 sandpaper to manufacture a fixing roll having a fluoro resin layer of 30 μm thickness.

The ten-point average roughness Rz of the obtained fixing roll was 1.5 μm and a number of grinding scratches were observed by naked eyes. The gloss was 65.7% and the angle of contact was 102°.

COMPARATIVE EXAMPLE 2

A fixing roll was manufactured using the same procedures as those in Comparative Example 1 except for mixing 0.75% by weight of carbon black with the solution of the PTFE resin (ED 4300 CRN, manufactured by Daikin Kogyo Co.).

The resultant fixing roll had a ten-point average roughness Rz of 1.5 μm, gloss of 70.4% and angle of contact of 104° to 106°.

COMPARATIVE EXAMPLE 3

A fixing roll was manufactured using the same procedures as those in Comparative Example 1 except for mixing 3% by weight of tin oxide with the solution of PTFE resin (ED 4300 CRN, manufactured by Daikin Kogyo Co.).

The resultant fixing roll had a ten-point average roughness Rz of 1.5 μm, gloss of 65.1% and angle of contact of 98° to 102°.

COMPARATIVE EXAMPLE 4

A primer (EK 1909 BKN, manufactured by Daikin Kogyo Co.) was coated on a hollow core having 30 mm diameter and 300 mm length and dried at 80° C. for about 30 min.

Subsequently, it was sintered at 380° C. for 30 min. Then, the core was rotated in contact with a press roll having a mirror-finished surface under a pressure of about 40 kg and the press roll was axially moved at a rate of 2 cm/sec. while softening the surface of the fluoro resin by means of a heat gun, whereby the fixing roll had a fluoro resin layer of 30 μm thickness.

The thus resulting fixing roll had a ten-point average roughness Rz of 1.95 μm and a surface gloss of 69.3%, in which cloudy spots were distributed all over the surface having specular glossiness. Further, upon microscopic observation, a plurality of stripe flaws caused by the press roll were observed.

The angle of contact was 104° to 106°.

COMPARATIVE EXAMPLE 5

A fixing roll was manufactured using the same procedures as those in Comparative Example 4 except for mixing 0.75% by weight of carbon black into a solution of a PTFE resin (ED 4300 CRN, manufactured by Daikin Kogyo Co.).

The thus obtained fixing roll had a ten-point average roughness Rz of 1.9 μm, gloss of 73.6% and appearance similar to that of Comparative Example 4. Further, the angle of contact was 106° to 108°.

COMPARATIVE EXAMPLE 6

A fixing roll was manufactured using the same procedures as those in Comparative Example 4 except for PTFE resin (ED 4300 CRN, manufactured by Daikin Kogyo Co.).

The thus obtained fixing roll had a ten-point average roughness Rz of 1.9 μm, gloss of 69.4% and an appearance similar to that of Comparative Example 4. Further, the angle of contact was 101° to 104°.

TEST EXAMPLE 1

After incorporating each of the fixing rolls in Examples 1-3 and Comparative Examples 1-6 into a copying machine and heating them to 240° C., the heater was turned off and paper was passed. Then, occurrence of offset phenomenon on the copied image was observed while the temperature at the roll surface was gradually lowered down to 130° C. Further, the amount of static charges was measured at the initial stage and after passage of 100 sheets of paper by using Monroe's surface potentiometer. Results are shown in Tables 1-3.

TABLE 1

| | Non-offset temperature range | Initial charge (V) | Charge after 100 paper sheets passed (V) |
|---|---|---|---|
| Example 1 | 180° C.-235° C. | −30--40 | −300--320 |
| Comp. Example 1 | 195° C.-220° C. | −30--40 | −300--350 |
| Comp. Example 4 | 195° C.-225° C. | −30--40 | −300--350 |

TABLE 2

| | Non-offset temperature range | Initial amount of charge (V) | Charge after 100 paper sheets passed (V) |
|---|---|---|---|
| Example 2 | 155° C.-230° C. | −30--40 | −40--60 |
| Comp. Example 2 | 165° C.-190° C. | −30--40 | −100--120 |
| Comp. Example 5 | 160° C.-210° C. | −30--40 | −80--100 |

TABLE 3

| | Non-offset temperature range | Initial amount of charge (V) | Charge after 100 paper sheets passed (V) |
|---|---|---|---|
| Example 3 | 155° C.-220° C. | −30--40 | −40--60 |
| Comp. Example 3 | 165° C.-180° C. | −30--40 | −110--120 |
| Comp. Example 6 | 165° C.-200° C. | −30--40 | −110--120 |

From the results as described above, it can be seen that the roll according to the present invention shows satisfactory results in view of a wide non-offset temperature range and charge eliminating performance in any of the cases, without fillers, with carbon, and with tin oxide. Further, from Tables 2 and 3, in particular, there is a remarkable difference in the charge eliminating effect though the filler amount is equivalent, and it can thus be seen that the property of the fillers can be effectively enhanced in the present invention.

Next, a silicone oil having a viscosity of 100 cs at an ordinary temperature was kept at a temperature of 200° C. in which the rolls of Example 1 and Comparative Example 1 were immersed respectively for observation concerning the peeling or stripping (exfoliation) of the fluoro resin layer. The roll of Comparative Example 1 showed exfoliation of 10/100 after 216 hours and 40/100 after 240 hours in a score peeling test, whereas the roll of Example 1 showed no exfoliation at all even after a lapse of 300 hours.

Then, the rolling of Example 2 and Comparative Example 2 were incorporated into a copying machine to observe abrasion due to edges of the copy sheets and abrasion due to the separating finger. In Example 2, the surface roughness, Rmax, in a portion where the edge portion of copy paper is passed, was 2.5 μm at the initial state and 3.2 μm after passage of 30,000 sheets, and, in a portion where the separation finger is in contact with the roll surface, 3 μm at the initial stage and 1.8 μm after passage of 30,000 sheets. However, in Comparative Example 2, in the portion where the edge of the copy paper is passed, the surface roughness Rmax was 2 μm at the initial stage and 8 μm after passage of 30,000 sheets, and, in the portion where the separation finger is in contact with the roll surface, the surface roughness Rmax was 1.5 μm at the initial state and 5.5 μm after the passage of 30,000 sheets. Thus, the roll of Example 2 shows outstandingly excellent abrasion resistance.

EXAMPLES 4-6 AND COMPARATIVE EXAMPLES 7-8

Fixing rolls for Examples 4-6 were manufactured quite in the same procedures as those in Example 2 except for mixing an amount of carbon black of 0.5, 1 and 3% by weight, respectively.

Further, fixing rolls for Comparative Examples 7-8 were manufactured quite in the same procedures as those in Comparative Example 2 except for mixing the amount of carbon black of 3 and 5% by weight, respectively.

TEST EXAMPLE 2

Occurrence of offset phenomenon in the copied image and the amount of static charges were examined for each of the fixing rolls in Examples 4-6 and Comparative Examples 7 and 8 in the same methods as those in Test Example 1.

The results are shown in Table 4.

TABLE 4

| | Non-offset temperature range | Initial charge (V) | Charge after 100 paper sheets passed (V) |
|---|---|---|---|
| Example 4 | 155° C.-230° C. | −30--40 | −50--70 |
| Example 5 | 155° C.-225° C. | −30--40 | −30--50 |
| Example 6 | 155° C.-220° C. | −30--40 | −25--45 |
| Comp. Example 7 | 155° C.-185° C. | −30--40 | −50--70 |
| Comp. | 155° C.-175° C. | −30--40 | −30--50 |

TABLE 4-continued

| | Non-offset temperature range | Initial charge (V) | Charge after 100 paper sheets passed (V) |
|---|---|---|---|
| Example 8 | | | |

From the result of Table 4, it can be seen that the rolls according to the present invention have equal or better charge-eliminating property with less carbon content than conventional rolls.

The fixing roll used for electrophotography according to the present invention has a wide non-offset temperature range, excellent abrasion resistance and durability to silicone oil. It has an advantage of remarkably enhancing the effect of fillers for providing electroconductivity and of easiness in manufacturing.

What is claimed is:

1. A fixing roll for electrophotography in which a fluoro-resin layer having a surface roughness Rz of not greater than 3.5 μm a gloss of not greater than 50% and an angle of contact with water of not less than 115° is coated on the outer surface of a core.

2. The fixing roll of claim 1, wherein the fluoro-resin is polytetrafluoroethylene.

3. The fixing roll of claim 1, wherein the fluoro-resin is a copolymer of tetrafluoroethylene and perfluoroalkylperfluorovinyl ether.

4. The fixing roll of claim 1, wherein the core is hollow.

5. The fixing roll of claim 1, wherein the thickness of the fluoro-resin layer is 30 μm.

6. The fixing roll of claim 1, wherein said fluoro-resin layer includes a filler.

7. The fixing roll of claim 6, wherein the filler is fibrous or finely powdered.

8. The fixing roll of claim 6, wherein the filler is selected from the group consisting of carbon, potassium titanate, metal oxides, ceramic, glass and metal.

9. The fixing roll of claim 6, wherein the filler has charge eliminating or abrasion resistant properties.

10. The fixing roll of claim 6, wherein the filler is carbon.

11. The fixing roll of claim 10, wherein the carbon comprises 0.5 to 3.0% by weight of the coating.

12. The fixing roll of claim 6, wherein the filler is tin oxide.

13. A fixing roll for electrophotography in which a fluoro-resin layer having a surface roughness, $R_z$ of not greater than 3.5 μm, a gloss of not greater than 50% and an angle of contact with water of not less than 115° is coated on an outer surface of a roll, wherein said fixing roll is produced by coating a fluoro-resin paint on the surface of a core thereby forming a coating layer, applying a smoothing fabrication to the surface of said coating layer and, subsequently, applying a heat treatment to form a fused fluoro-resin layer.

* * * * *